United States Patent [19]

Delassus

[11] 4,200,141

[45] Apr. 29, 1980

[54] ELECTROMAGNETIC INDUCTOR INGOT MOLD FOR CONTINUOUS CASTING

[75] Inventor: Jean Delassus, Montmorency, France

[73] Assignee: CEM Compagnie Electro-Mecanique, Paris, France

[21] Appl. No.: 911,651

[22] Filed: Jun. 1, 1978

[30] Foreign Application Priority Data

Jun. 7, 1977 [FR] France ..... 77 17360

[51] Int. Cl.[2] ..... B22C 27/02; B22C 11/00

[52] U.S. Cl. ..... 164/147; 164/49

[58] Field of Search ..... 164/82, 48, 49, 146, 164/147, 250, 418; 336/92, 129, 134; 310/180, 184, 198–208, 254

[56] References Cited

U.S. PATENT DOCUMENTS

| | | | |
|---|---|---|---|
| 3,030,595 | 4/1962 | Campbell | 336/134 |
| 4,009,749 | 3/1977 | Alberny | 164/147 |
| 4,040,467 | 8/1977 | Alberny et al. | 164/49 |
| 4,042,008 | 8/1977 | Alberny et al. | 164/147 |

FOREIGN PATENT DOCUMENTS

| | | | |
|---|---|---|---|
| 549242 | 5/1977 | U.S.S.R. | 164/147 |

*Primary Examiner*—Robert D. Baldwin
*Assistant Examiner*—K. Y. Lin
*Attorney, Agent, or Firm*—Burns, Doane, Swecker & Mathis

[57] ABSTRACT

An electromagnetic inductor ingot mold for the continuous casting of blooms includes water cooled boxes having opposed, parallel vertical walls which are spaced by means of braces arranged in a matrix. An inductor for creating a varying magnetic field is disposed within each of the boxes and includes a comb-shaped core. The core is subdivided into a plurality of individual circuits. The individual circuits and the rectilinear active conductors of the inductive windings of the inductor form a grid interlaced with the rows and columns of the matrix arrangement of braces.

6 Claims, 7 Drawing Figures

ELECTROMAGNETIC INDUCTOR INGOT MOLD FOR CONTINUOUS CASTING

BACKGROUND OF THE INVENTION

The present invention relates to an electromagnetic inductor ingot mold for the continuous castings of blooms. The mold includes two relatively large and two relatively small rectangular, vertically disposed walls assembled to define a passage having an elongated rectangular section for the casting of a bloom. At least each of the two relatively large walls is formed by a water cooled box which cools the molten metal in the mold. Each cooling box includes a rectangular vertical wall which is parallel to the relatively large wall forming the mold and which is held away from the mold wall by means of braces formed of bars. The braces are arranged in rows and columns in a matrix arrangement. An electromagnetic inductor is housed in each of the cooling boxes and comprises a magnetic circuit having inductive windings connected to a power source so as to create a varying magnetic field.

With the increasing development of continuous casting, and the heretofore recognized success of electromagnetic rabbling, i.e., stirring, it is desireable to combine these two processes in the molding of liquid metal into ingot molds.

By putting molten metal into movement upon its introduction into an ingot mold through electromagnetic rabbling, the impurities in suspension in the liquid metal are removed from the zone at which solidification of the metal begins. These impurities can be recovered in the form of slag on the surface of the molten bath.

Electromagnetic rabbling in an ingot mold has been previously used with ingot molds for the continuous casting of billets. In these systems, an inductor which is capable of creating a rotating magnetic field is incorporated in a cooling box placed around a casting pipe.

In the case of ingot molds for continuous casting of blooms, however, a problem arises due to the fact that the casting well is formed by the fitted assembly of four vertical walls made up of separable cooling boxes. These boxes are closed and are not in fluid communication with one another. The two relatively large boxes forming the large faces of the bloom and the two relatively small boxes which are perpendicularly disposed with respect to the large boxes and in contact with the small faces of the bloom each form independent cooling volumes.

Furthermore, only the two relatively large boxes provide sufficient useful volume to house an electromagnetic inductor therein. Normally, one inductor is placed adjacent each large face of the ingot mold and a continuous field surrounding the mold cannot be created.

In addition to the difficulty presented by not having a continuous field around the mold a further problems is presented due to the small amount of space available in which to house the inductor. The braces or other similar devices which space the large internal and external vertical walls of the relatively large cooling boxes cut down on the amount of space available for an inductor.

One proposed solution to this problem is disclosed in French patent application 75.28439, filed Sept. 17, 1975 and published under number 2,324,395. In an ingot mold of the typed described previously, the braces are formed of bars and function as both the spacing pieces for the structure and polar pieces for the magnetic circuit of the inductor (FIGS. 5 and 6 of the patent application). This arrangement has the drawback of requiring massive poles which necessarily limit the value of the induction and, consequently, the effectiveness of the rabbling.

It is an object of the present invention to remedy this drawback by providing an inductor which is capable of being housed in existing ingot molds of the type in which the relatively large internal and external walls of the cooling boxes are held apart by braces formed of bars arranged in a matrix arrangement, and which is able to produce more effective rabbling.

To achieve this purpose, an ingot mold according to the present invention has an inductor which includes comb-shaped cores with slots parallel to either the horizontal or vertical directions. The core is subdivided, perpendicular to the direction of the slots, into individual magnetic circuits. The inductive winding of each circuit comprises two parallel groups of rectilinear active conductors housed in the slots of the core. The individual magnetic circuits and the groups of rectilinear active conductors of the inductive windings form a grid interlaced within the lines and columns of the matrix arrangement formed by the braces.

With this arrangement, it is possible to otain a magnetic field which varies vertically or horizontally, depending on whether the individual magnetic circuits are arranged vertically or horizontally, respectively, and whether the groups of rectilinear active conductors of the inductive windings are arranged respectively horizontally or vertically.

Ingot molds for continuous casting of blooms are known which comprise one or more electromagnetic inductors per cooling box, with each inductor having a magnetic circuit in the form of a comb with slots parallel to either the vertical or horizontal directions and with each winding comprising two groups of rectilinear active conductors housed in the slots of the magnetic circuit. Such arrangements are disclosed, for example, in French patent application No. 2,324,395, previously cited, (FIGS. 2 and 3) or French patent application published under No. 2,324,397 (FIG. 2). The teeth or polar pieces of the magnetic circuits described in these two French patent applications also serve as support pieces between the large vertical walls of the cooling boxes. However, such magnetic circuits cannot be housed in the cooling boxes of existing ingot molds of the type in which the support pieces are made up of a matrix arrangement of braces formed of bars.

DETAILED DESCRIPTION

Figure 1:
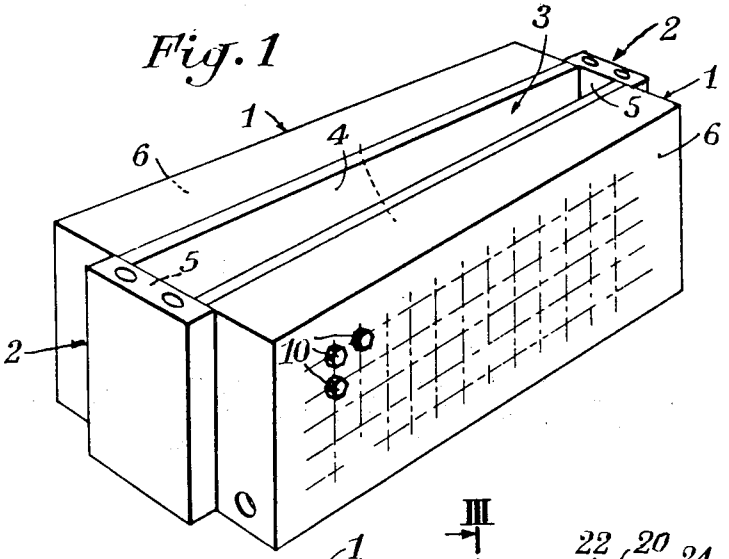
FIG. 1 is a perspective view of an ingot mold.

The ingot mold shown in FIG. 1 comprises two relatively large boxes 1 which are adapted for water cooling and two relatively small boxes 2 which can also be adapted for water cooling. These boxes are assembled together in a known manner. The casting space for the bloom is located in the space 3 defined by the two large internal walls 4 of the relatively large boxes 1 and by the two internal walls 5 of the two relatively small boxes 2. These internal walls 4 and 5 are constructed with a non-magnetic metal that is a good heat conductor, preferably a copper alloy. The other walls of the boxes 1, 2 can be made of steel.

The large boxes 1 which form to the large faces of the bloom are much thicker than the smaller boxes so as to be able to house an inductor. In one example, the smaller boxes 2 can simply be made up of thick plates provided with internal ducts for the circulation of cooling water.

Given the large surface of the large internal walls 4 and the high pressure of the cooling water (about 10 bars), it is necessary to provide support and spacing pieces to maintain a fairly uniform separation between the large internal walls 4 and the outside walls 6 of the larger boxes 1. The walls 4, 6 should be maintained parallel to each other and can be reinforced in a known manner to resist pressure stresses.

Figure 6:
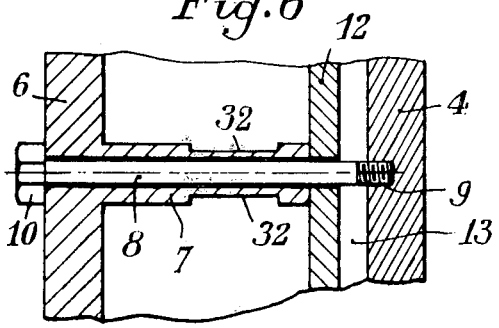
FIG. 6 is a partial view in section and on an enlarged scale showing the details of a support brace as illustrated in FIG. 3.

In most existing ingot molds, these support and spacer pieces are made up of braces 7 in the form of hollow bars and ties 8 that go into the bores of the braces 7 and which are screwed into threaded blind-end holes 9 of the large inside walls 4, as shown in FIG. 6. Heads 10 of the ties 8 rest against the outside face of the outside wall 6 and are accessible from the outside. As more clearly shown in FIG. 2, the braces 7 and their associated ties 8 are arranged in rows and columns to form a matrix arrangement.

Figure 3:
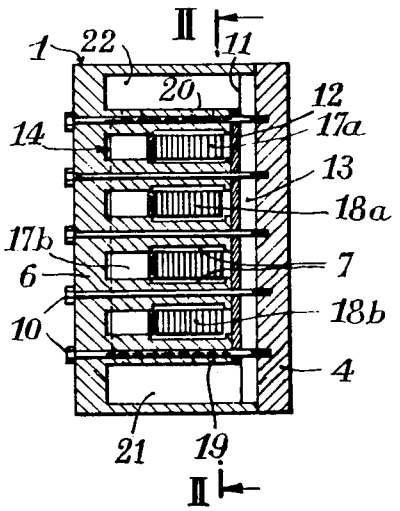
FIG. 3 is a view in vertical section along line III—III of FIG. 2.

The large internal wall 4 and the large external wall 6 of a box 1, and the ties 8 that pass through the bores of the braces 7 are illustrated in FIG. 3. The braces 7 can be made up of bars that are independent, or made integrally with the wall 6. Wall 4 contains vertical ribs 11 on its interior surface, which ribs extend almost to the ends of the wall 4. Under the force of the ties 8, the interior edges of the ribs 11 abut against a counterplate 12 which rests against the ends of braces 7. The ribs 11, the wall 4 and the counterplate 12 form circulation ducts 13 which facilitate the forced cooling of the wall 4. The counterplate 12 is made of a non-magnetic material, for example, copper or a copper alloy. As shown in FIG. 3, the counterplate 12 extends vertically from the lower row to the upper row of the braces 7. Alternatively, the counterplate 12 could extend over the entire height of the box 1 if intake and exit orifices are provided in the lower and upper parts of the counterplate for the water circulating in the ducts 13.

In cooling boxes conventionally constructed as described previously, it is difficult to house between the outside wall 6 and the counterplate 12 an inductor which is able to produce an intense magnetic field to assure an effective rabblinhg of the liquid metal when it is poured into the ingot mold, due to the presence of the braces 7.

Figure 4:
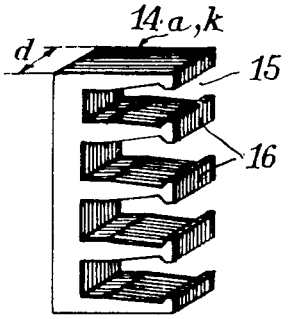
FIG. 4 is a view in perspective showing a core for one of the individual magnetic circuits included in the inductor shown in FIGS. 2 and 3.

In accordance with the present invention, this problem is overcome by using an inductive circuit 14 which includes comb-shaped cores and which is subdivided into individual magnetic circuits 14*a*–14*k*, which are also comb-shaped. As shown in FIG. 4, each individual magnetic circuit 14*a*,14*k* can be made up of a packet of magnetic sheets assembled and pasted together. The sheets comprise slots 15 and teeth 16. The packet of sheets have a thickness d which corresponds to the space d available between two adjacent columns (FIG. 2) or two adjacent rows (FIG. 7) of the braces 7.

Figure 2:
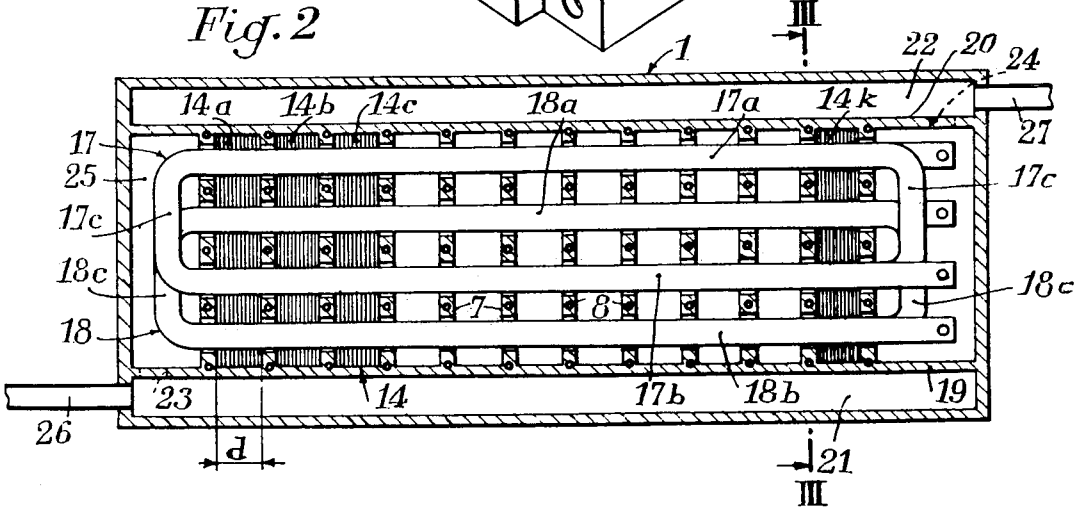
FIG. 2 is a view in vertical section of one of the two relatively large cooling boxes of the ingot mold of FIG. 1, the section being made along line II—II of FIG. 3, showing a first embodiment of the inductor in the cooling box to obtain a vertically varying magnetic field.

In FIGS. 2 and 3, each individual magnetic circuit 14*a* to 14*k* is arranged vertically between two adjacent columns of braces 7, and their slots are aligned in the spaces between the rows of braces 7. Two inductive windings 17 and 18, having a generally rectangular shape, are arranged with their rectilinear active conductors 17*a*, 17*b* and 18*a*, 18*b* placed horizontally in the slots aligned between the rows of braces 7. Heads 17*c* and 18*c* of windings 17 and 18 come out beyond the outside individual magnetic circuits 14*a* and 14*k* and are suitably bent to be able to overlap. Windings 17 and 18 are connected to a two-phase alternating current source (not shown) to create a vertically varying magnetic field.

As can be seen more particularly in FIG. 2, the lower and upper rows of braces 7 are formed integral with the lower and upper partitions 19 and 20. These partitions extend over the entire length of the box 1 to define two lower and upper water channels 21 and 22, respectively, for the entry and exit of cooling water. Orifices 23 and 24 in partitions 19 and 20 permit the admission of cooling water from the channel 21 into the inductor enclosure 25 and the exit of the water from the enclosure 25 into the channel 22.

A volume of water which is approximately 50 to 100 times greater than that going through enclosure 25 passes through the ducts 13 along the inside wall 4 in contact with the metal that is solidifying due to the size of the orifices 23,24. The channel 21 is supplied with water by a conduit 26, while the cooling water, after passage into either the enclosure 25 or the ducts 13, is evacuated from the water channel 22 by means of a conduit 27.

Figure 5:
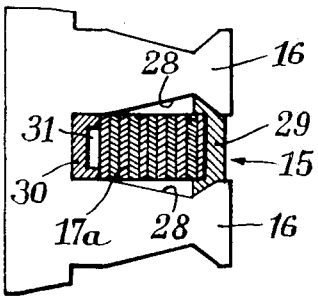
FIG. 5 is a partial view in section and on an enlarged scale showing a group of conductors of a winding in a slot of the magnetic core.

As shown in FIG. 5, the slots 15 of the magnetic circuits can include on their lateral faces recesses 28. These recesses serve to increase the amount of surface area of the insulated conductor groups which are in contact with cooling water, as shown.

FIG. 5 illustrates that each conductor group, for example the group 17*a*, can be wedged in the slots 15 of the individual magnetic circuits by means of dovetail wedges 29 placed at the exterior sides of the slot. In the interior of the slots 15, wedges 30, having recesses 31 facing the conductor group 17*a* to permit the passage of the cooling water, insulate the conductor groups for the core 16. As shown in FIG. 6, recesses 32 are also provided in the braces 7 to improve the passage of the cooling water between the conductor groups and the braces 7.

Figure 7:
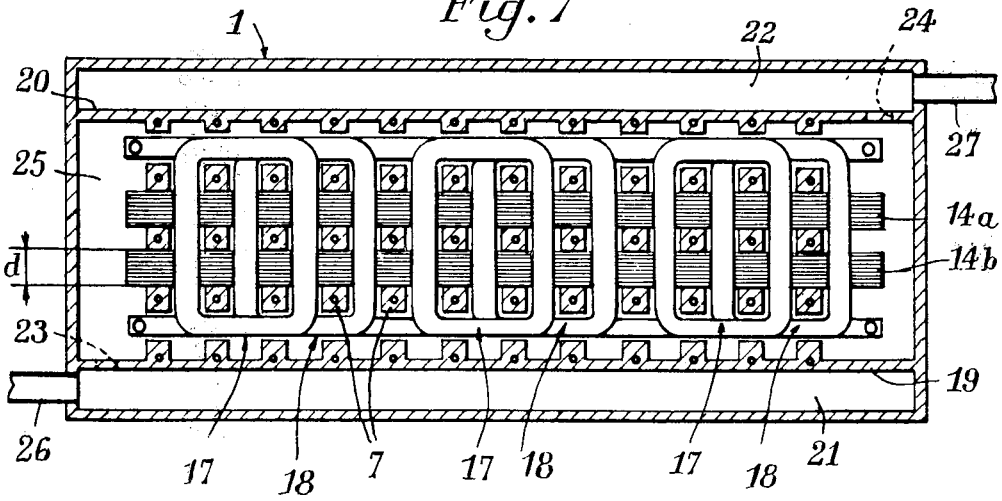
FIG. 7 is a view similar to FIG. 2 showing a second embodiment of the inductor to obtain a horizontally varying magnetic field.

FIG. 7 illustrates a second embodiment of the inductor circuit 14 and windings 17 and 18 which permits a horizontally varying magnetic field to be set up. In this case, the inductor circuit 14 is subdivided into two individual circuits 14*a* and 14*b*. These circuits are also in the shape of a comb, but are longer and have a greater number of teeth that those of FIG. 2. Each individual circuit 14a, 14b is placed horizontally between adjacent rows of braces 7, and their slots are aligned in the spaces between the columns of braces 7. The two windings 17 and 18 are subdivided each into three individual windings whose rectilinear active conductors are arranged vertically in the slots aligned between the columns of braces 7. The heads of the windings 17 and 18, are bent in a suitable manner to overlap, and are arranged in the spaces between the upper and lower pairs of adjacent rows of braces 7. The windings 17 and 18 are connected to a two-phase alternating current source (not shown).

It will be obvious that with a greater number of rows or columns of braces, it is possible to have a greater number of windings which could be connected to a multiphase current source, for example, a three-phase source.

The present invention may be embodied in other specific forms without departing from the spirit or essential characteristics thereof. The presently disclosed exemplary embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. An electromagnetic inductor ingot mold for the continuous casting of blooms, comprising:

two relatively large and two relatively small rectangular vertical walls assembled to define between them a passage having an elongated rectangular section for the casting of a bloom;

a box for water cooling associated with each of the two relatively large walls, including a second wall disposed parallel to the relatively large wall associated with the box;

braces arranged in a matrix of rows and columns for spacing said vertical walls from said second walls; and an electromagnetic inductor divided into a plurality of individual magnetic circuits and housed in each cooling box for creating a vertically varying magnetic field; including:

a generally comb-shaped core arranged vertically between two adjacent columns of said matrix arrangement of braces and having a plurality of teeth and a plurality of slots which are aligned in the spaces between the rows of said matrix arrangement; and at least two pairs of rectilinear active conductors horizontally disposed in the aligned slots between the rows of the matrix arrangement to form the windings of said inductor, wherein said core and said conductors form a gridwork which is interlaced with said matrix of braces.

2. An electromagnetic inductor ingot mold for the continuous casting of blooms, comprising:

two relatively large and two relatively small rectangular vertical walls assembled to define between them a passage having an elongated rectangular section for the casting of a bloom;

a box for water cooling associated with each of the two relatively large walls, including a second wall disposed parallel to the relatively large wall associated with the box;

braces arranged in a matrix of rows and columns for spacing said vertical walls from said second walls; and an electromagnetic inductor divided into a plurality of individual magnetic circuits and housed in each cooling box for creating a horizontally varying magnetic field, including;

a generally comb-shaped core arranged horizontally between two adjacent rows of said matrix arrangement of the braces and having a plurality of teeth and a plurality of slots wherein the slots of the core are aligned in spaces between the columns of the matrix arrangement; and at least two pairs of rectilinear active conductors arranged vertically in aligned slots between the columns of said matrix arrangement to form the windings of said inductor, wherein said core and said conductors form a gridwork which is interlaced with said matrix of braces.

3. An ingot mold according to claims 1 or 2, wherein said individual magnetic circuits are made of thin magnetic sheets which are assembled and pasted together.

4. An Ingot mold according to claim 1 or 2, wherein said slots include recesses in their lateral faces to permit a circulation of cooling water between said core and said rectilinear active conductors.

5. An ingot mold according to claim 1 or 2 wherein said braces have recesses to permit the passage of cooling water between said conductors and the braces.

6. An ingot mold according to claim 1 or 2 wherein each of said conductors is insulated from the core at the bottom of the slot in which it is housed by means of wedges having recesses facing the group of conductors, to permit the passage of cooling water between the conductor and the insulating wedges.

* * * * *